US011166515B1

(12) United States Patent
Hajianpour

(10) Patent No.: US 11,166,515 B1
(45) Date of Patent: Nov. 9, 2021

(54) HELMET/HOOD ASSEMBLY STRUCTURE AND METHOD OF USE THEREOF

(71) Applicant: Mohammed Ali Hajianpour, Fort Lauderdale, FL (US)

(72) Inventor: Mohammed Ali Hajianpour, Fort Lauderdale, FL (US)

( * ) Notice: Subject to any disclaimer, the term of this patent is extended or adjusted under 35 U.S.C. 154(b) by 246 days.

(21) Appl. No.: 15/284,642

(22) Filed: Oct. 4, 2016

Related U.S. Application Data

(63) Continuation-in-part of application No. 14/734,215, filed on Jun. 12, 2015, now Pat. No. 9,956,825, and a continuation-in-part of application No. 14/605,213, filed on Jan. 26, 2015, now abandoned.

(51) Int. Cl.

| | |
|---|---|
| ***A42B 3/32*** | (2006.01) |
| ***A42B 3/28*** | (2006.01) |
| ***A42B 3/22*** | (2006.01) |
| ***A42B 3/04*** | (2006.01) |
| ***A42B 3/00*** | (2006.01) |
| ***A42B 3/08*** | (2006.01) |

(52) U.S. Cl.
CPC ..... *A42B 3/322* (2013.01); *A42B 3/006* (2013.01); *A42B 3/044* (2013.01); *A42B 3/08* (2013.01); *A42B 3/225* (2013.01); *A42B 3/283* (2013.01); *A42B 3/286* (2013.01); *A42B 3/324* (2013.01)

(58) Field of Classification Search
CPC ..... A42B 3/006; A42B 3/286; A42B 3/225; A42B 3/22; A42B 3/32; A42B 3/322; A42B 3/324; A42B 3/326; A42B 3/08; A42B 3/283; A42B 3/044; A42B 1/201; A42B 1/062; A61F 9/06; A61F 9/045; A62B 17/04
USPC ..... 2/9, 6.3, 8.2, 15, 454
See application file for complete search history.

(56) References Cited

U.S. PATENT DOCUMENTS

| | | | | |
|---|---|---|---|---|
| 3,685,054 A | | 8/1972 | Raschke | |
| 3,991,422 A | | 11/1976 | Saotome | |
| 4,280,491 A | * | 7/1981 | Berg | A61F 9/068 128/201.24 |
| 4,605,292 A | | 8/1986 | Mcintosh | |
| 5,628,071 A | | 5/1997 | Nezer | |
| 5,673,431 A | * | 10/1997 | Batty | A42B 3/225 2/10 |
| 6,282,726 B1 | * | 9/2001 | Noyerie | A42B 3/226 2/424 |
| 6,374,823 B1 | | 4/2002 | Hajianpour | |

(Continued)

FOREIGN PATENT DOCUMENTS

| | | |
|---|---|---|
| EP | 2117367 | 11/2009 |
| WO | 2008106135 | 9/2008 |
| WO | 2014160149 | 10/2014 |

*Primary Examiner* — Nathan E Durham
*Assistant Examiner* — Abby M Spatz
(74) *Attorney, Agent, or Firm* — Withers & Keys, LLC

(57) ABSTRACT

A helmet/hood assembly includes a housing, a headband support assembly configured to hold the assembly on a human head, a face shield, and a flexible hood attached to the housing and to the face shield, with the assembly being received, stored, used, and disposed as a single unit. The headband support assembly pivots on the housing between a configuration suitable for shipping and storing the assembly and a configuration in which the assembly is worn. An accessory light powered by a battery may be held in place on the housing by magnetic attraction through the hood.

14 Claims, 7 Drawing Sheets

(56) References Cited

U.S. PATENT DOCUMENTS

| | | | | |
|---|---|---|---|---|
| 7,264,368 | B2 * | 9/2007 | Sherring | A42B 3/04 2/906 |
| 7,357,135 | B2 | 4/2008 | Cunningham | |
| 7,937,775 | B2 | 5/2011 | Manzella et al. | |
| 8,020,552 | B2 | 9/2011 | Dillon et al. | |
| 9,980,529 | B1 | 5/2018 | Hajianpour | |
| 2001/0032348 | A1 | 10/2001 | Diaz | |
| 2007/0050898 | A1 * | 3/2007 | Larson | A41D 13/1209 2/456 |
| 2007/0089221 | A1 | 4/2007 | Manzella | |
| 2007/0113318 | A1 * | 5/2007 | Weston | A42B 3/281 2/171.3 |
| 2008/0202509 | A1 | 8/2008 | Dillon et al. | |
| 2008/0289974 | A1 * | 11/2008 | McClore | A45C 11/02 206/8 |
| 2009/0078259 | A1 * | 3/2009 | Kooij | A61M 16/0875 128/205.25 |
| 2010/0095439 | A1 * | 4/2010 | Nolan | A42B 3/24 2/421 |
| 2013/0031693 | A1 * | 2/2013 | Gleason | A42B 3/225 2/9 |
| 2014/0039273 | A1 * | 2/2014 | Kim | A61B 90/35 600/249 |
| 2014/0352037 | A1 | 12/2014 | VanDerWoude | |
| 2015/0151070 | A1 | 6/2015 | Capra | |
| 2015/0327617 | A1 | 11/2015 | Gaudillere | |
| 2016/0331059 | A1 * | 11/2016 | Basson | A42B 3/085 |
| 2017/0000207 | A1 | 1/2017 | Hajianpour | |

* cited by examiner

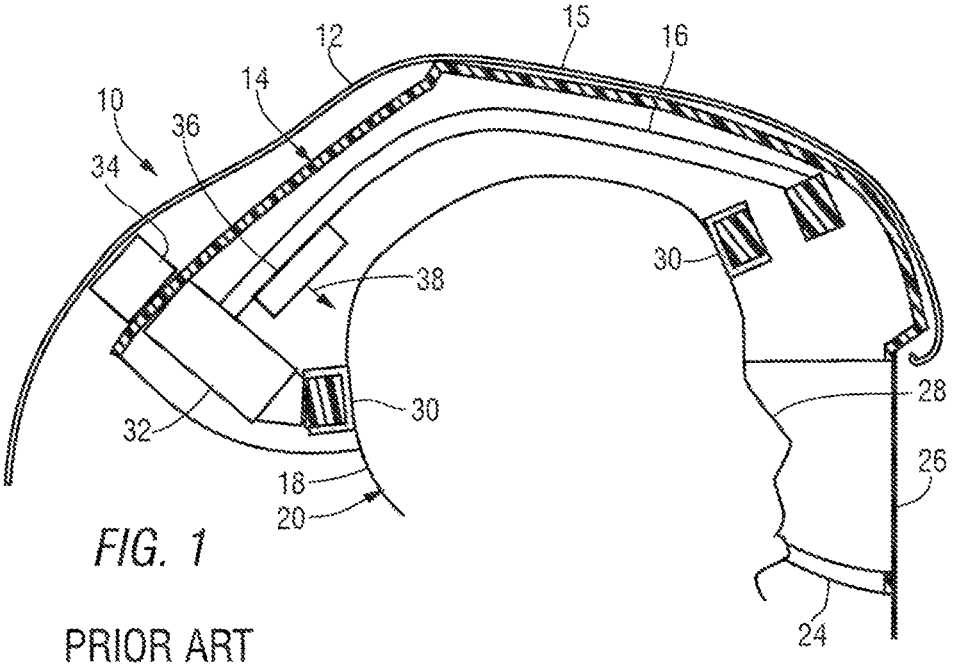
FIG. 1
PRIOR ART
FIG. 2
PRIOR ART
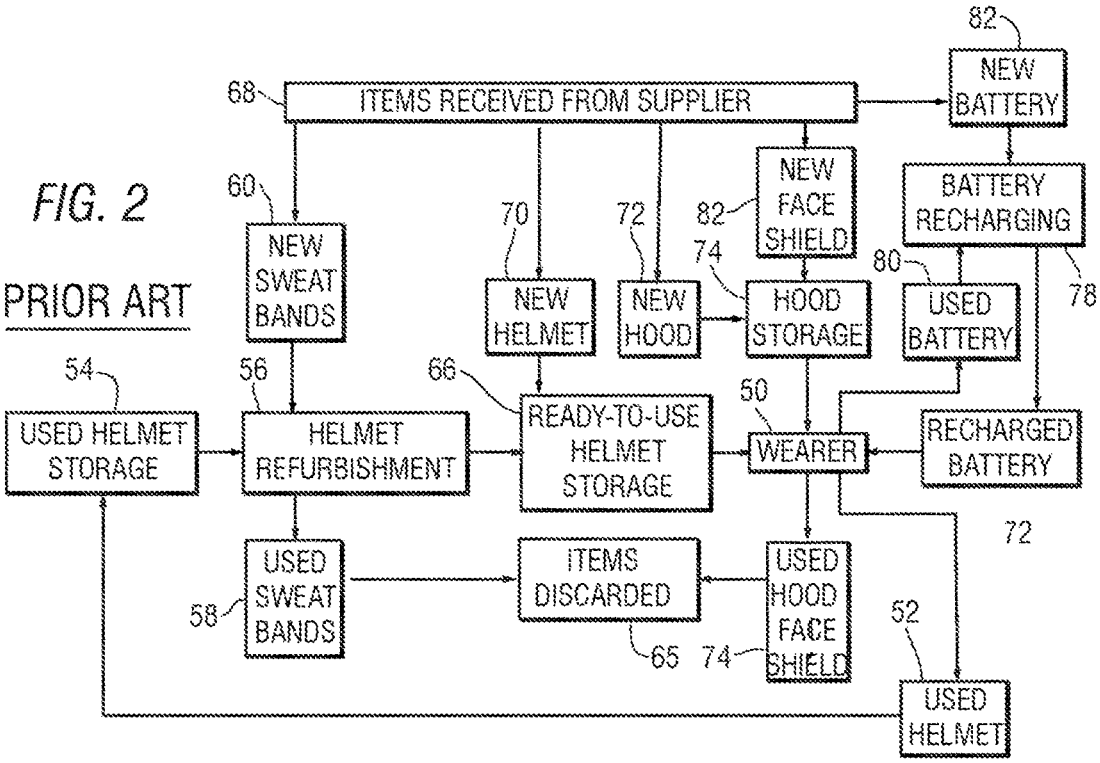

HELMET/HOOD ASSEMBLY STRUCTURE AND METHOD OF USE THEREOF

RELATED APPLICATIONS

This is a continuation-in-part of U.S. patent application Ser. No. 14/738,215, filed Jun. 12, 2015, which is a is a continuation-in-part of U.S. patent application Ser. No. 14/605,213, filed Jan. 26, 2013.

FEDERALLY SPONSORED RESEARCH OR DEVELOPMENT

Not Applicable

BACKGROUND OF THE INVENTION

1. Field of the Invention

This invention relates to a helmet/hood assembly to be worn by surgical personnel and, more particularly, to such a helmet/hood assembly having a structure and assembly process configured to provide for a significantly reduction in the space required for storing the helmet/hood assembly.

2. Summary of the Background Information

For thousands of years, people have made and worn various types of helmets to provide protection of the head from physical injury in war, sports, various occupations, and in forms of transportation, such as riding a bicycle or motorcycle, in which the head is exposed. When a suitable helmet was worn, the head was protected against blunt trauma, cutting edges, and projectiles, with helmets being strong, rigid, and designed to extend over the entire head. In the 1960's and 1970's it became apparent that a different kind of helmet was needed to protect operating room personnel and patients undergoing surgical procedures from contamination by one another. Specifically, a system was needed to provide separate airspaces in which each of the operating room personnel would breath and in which the surgical procedure would occur, so that the surgical site would not be contaminated by airborne contaminates exhaled or otherwise expelled by the operating room personnel, and additionally so that the operating room personnel will not be contaminated by blood splatter and other airborne contamination from the surgical site.

This need has been filled by a number of types of ventilated helmet/hood systems, each including a flexible hood, a transparent face shield, and a rigid helmet extending under the flexible hood to hold the flexible hood in place. Initially, air was supplied to a space within the helmet through a flexible hose from supply of clean air. However, since the air supply connections through hoses placed too many limitations on the movements of the operating room personnel, a portable air supply was developed, with an electrically-driven fan attached to the waist of each operating room person drawing air from behind his back, and with the air being supplied to his helmet through a flexible tube.

Then, circa 1975, the fan was instead placed within the helmet, forming a type of system shown in the schematic view of FIG. 1 that has become widely used as the conventional ventilated helmet/hood apparatus 10 for operating room personnel. The helmet/hood apparatus 10 includes a flexible hood 12 placed over a helmet 14, which supports the hood 12, giving its top portion 15 shape. The helmet 14 in turn includes a support assembly 16 configured for engaging the head 18 of the wearer 20, a housing 22, and a frame 24 configured for holding a transparent face shield 26 in front of the face 28 of the wearer 20. The support assembly 16 includes replaceable sweat bands 30 that are configured to be held against the head 18 and an adjustment mechanism 32 that adjusts the spacing between the sweat bands 20 to fit the head 48 in response to the rotation of an adjustment knob 34. Both the sweat bands 30 and the face shield 26 are replaced after each use, being adhesively attached within the helmet 14. The apparatus 10 further includes a fan 36 moving air in the direction of arrow 38 within the helmet 14.

A first limitation of the conventional approach using the helmet/hood apparatus 10 arises from the fact that the helmet 18 has been designed as a traditional helmet that completely surrounds the head of the wearer, protecting the head from injury due to blows. Therefore, the helmet 18 is unnecessarily large, resulting in increased costs for shipping and storage, and heavy, resulting in added discomfort for the wearer.

A second limitation of the conventional approach using the helmet/hood apparatus 10 arises from the fact that, while structures within the helmet 14 may include slots 36 allowing air movement, there are no openings within the upper portion 15 of the hood 12 through which fresh air can be drawn, or through which air may be exhausted. While some air is allowed to move inward and outward through spaces between the body of the wearer 20 and a lower edge (not shown) of the hood 12, a lack of air paths through the upper portion 15 of the hood implies that the vast majority of the air moved by the fan 36 is being recirculated within the helmet/hood apparatus 10 as levels of carbon dioxide within the apparatus 10 are allowed to rise, resulting in a possible reduction in the level of the technical skills of the medical personnel wearing the apparatus 10.

A third limitation of the conventional approach using the helmet/hood apparatus 10 arises from the fact that the adjustment knob 34 is located at the rear of the helmet 14. If the wearer 20 determines that the support assembly 16 is too loose or too tight, he cannot remove one of his hands from the sterile field to reach the knob 24 behind his head. He must instead have another individual perform the adjustment.

The helmet 14 is conventionally reused by other users 20 in other surgical procedures, while the hood 12 and face shield 26, which are each directly exposed to contamination by blood splatter during surgery, and the sweat bands 30 are replaced following each use of the helmet/hood 10. A rechargeable battery, attached to the wearer 20 by a belt, is connected to the helmet 14 power the fan 36.

FIG. 2 is a schematic view of the flow of parts within a hospital to provide helmet/hood apparatus as needed for operating room personnel. In this process, the vast majority of the helmets that are provided for operating room personnel, indicated as wearers 50, begin as used helmets 52, which are stored in a helmet storage area 54 and refurbished in an area 56, with the refurbishment process replacing used sweat bands 58 with new sweat bands 60 and including cleaning the used helmets, with a refurbished helmet being then placed in ready-to-use helmet storage 66. The new sweat bands 60 are obtained from one or more suppliers, indicated herein as 68. New helmets 70 can also be obtained in this way for placement in ready-to-use helmet storage 68. New hoods 72 and new face shields 73 are additionally obtained from suppliers 68, being attached to one another and placed in hood storage 74. Since hoods and face shields are not reused, used hoods and face shields 74 are discarded at 65.

As a wearer 50 is prepared for surgery, a helmet from ready-to-use helmet storage 66 is placed on his head and adjusted to fit using the adjustment knob 34. Then, a hood from hood storage 74 is placed over the helmet and over his shoulders. After the gown is placed on the wearer 50, since electrical power is required to operate the fan 36, a rechargeable battery 76, having been taken from a battery recharging area 78, is placed in the pocket of the gown worn by the wearer 50 or otherwise attached to his clothing and electrically connected to the fan 36. After the surgical procedure is completed, the wearer 50 removes the used helmet 52, which is returned to used helmet storage 54, the used hood and face shield 74, which are discarded at location 65, and a used battery 80, which is then stored and recharged at the recharging station 78, New batteries 82 may additionally be obtained from a supplier at 68 and placed into the recharging station 78.

A fourth limitation of the conventional approach using the helmet/hood apparatus 10 arises from the complexity of the process for preparing the apparatus 10 for use, with the replaceable items, the hood 12, face shield 26, and sweat pads 30 being separately received and installed, and with significant space being devoted to the storage and refurbishment of used helmets.

A fifth limitation of the conventional approach using the helmet/hood apparatus 10 arises from the fact that, the remaining portions of the helmet 14 are reused by multiple people, often additionally in multiple locations within a large facility, flying rise to a possibility of various kinds of cross-contamination. Including the spreading of disease from one location to another and among patients and hospital workers coming into contact with the used helmets.

A sixth limitation of the conventional approach using the helmet/hood apparatus 10 arises from the use of rechargeable batteries, which limits the use of the apparatus 10 to areas where electricity is available for recharging the battery, providing particular problems in remote areas and in disaster areas.

A seventh limitation of the conventional approach arises from the fact that a conventional helmet includes a headband assembly that extends horizontally, and a face shield that extend vertically, so that a packaged helmet takes up substantial space within a transport vehicle an within a hospital storage facility.

SUMMARY OF THE INVENTION

In accordance with one aspect of the invention, a helmet/hood assembly is provided, including a headband support assembly configured to extend around a human head, a face shield including a flexible transparent sheet, a housing, and a hood including a sheet of flexible material having a front opening, in which the face shield is attached. The face shield is additionally attached to the front end of the housing to extend in front of a face of a human head held within the headband with the helmet/hood assembly held in an operational configuration. The headband support assembly and the face shield are pivotally attached to one another through the housing, to be rotated relative to one another between the operational configuration and a packaged configuration, in which the helmet hood assembly takes up substantially less space within a rectangular package. Preferably, the headband support assembly is additionally attached to the face shield to hold the apparatus in the operational configuration. In addition, the helmet/hood assembly includes an air duct moving air from a region above and behind the helmet/hood assembly to a region between the face shield and the face of a person wearing the helmet/hood assembly.

As shown in a first embodiment, the packaged configuration is formed by reducing the overall width of the helmet/hood assembly within the package. The housing includes front, rear, and central sections, with the headband support assembly extending under the central sections and between the front and rear sections, being mounted to pivot about a longitudinal axis as the helmet/hood assembly is changed between the packaged configuration and the operational configuration. Since the headband support assembly is the widest portion of the helmet/hood assembly in the operational configuration, rotating the headband support assembly from extending horizontally in the operational configuration to extend vertically in the packaged configuration substantially reduces the width of the packaged configuration. For example, with the apparatus in the storage configuration, the headband assembly may not extend beyond the lateral sides of the housing. Preferably, the air duct is formed within the central and front portions of the housing.

As shown in a second embodiment, the packaged configuration is formed by reducing the overall height of the helmet/hood assembly within the package. The housing is rigidly attached to the headband support assembly and pivotally attached to face shield by a hinge to move so that the helmet/hood apparatus can be placed in the packaged configuration or in the operational configuration. Since the face shield extends downward from a front edge of the housing through a substantial distance in the operational configuration, pivoting the face shield to extend horizontally along a lower surface of the housing substantially reduces the height of the helmet/hood assembly in the packaged configuration. Preferably, structures disposed above the housing, such as the headband supporting assembly and the air duct, are configured to be flexible, so that they are downwardly compressed by the packaging, further reducing the height of the helmet/hood assembly in the packaged configuration.

Preferably, the headband within the headband support assembly is configured to be adjusted to fit on a human head. As shown in the first embodiment, the helmet/hood apparatus additionally includes an adjustment shaft having an adjustment knob at one end and an adjustment gear at the other end. The headband then includes a curved, elongated central section and an end section extending from each end of the to slide within a slotted tube forming part of the headband support assembly. Each of the end sections includes a rack, with the two racks engaging opposite sides of the adjustment gear, which is driven in rotation within the slotted member by the adjustment shaft, so that turning the adjustment knob in a first directions tightens the headband, while turning the adjustment knob opposite the first directions loosens the headband. As shown in the second embodiment, the headband includes an elongated strip having ends attached to one another through a variable distance to form an overlapping region.

Preferably, the helmet/hood assembly includes a provision for removably attaching an accessory, such as a helmet light. For example, the provision includes an outwardly and forwardly facing magnetically attractable plate disposed in a front portion of the helmet. The provision may additionally include an outwardly and rearwardly facing magnetically attractable plate disposed in a rear portion of the helmet.

In accordance with another aspect of the invention, a packaged helmet/hood assembly is provided, including a package in which the helmet/hood assembly is held. The helmet/hood assembly includes a headband support assembly, a housing, and a hood. The headband support assembly includes a headband configured to extend around a human head. The face shield includes a flexible transparent film sheet, attached to the front portion of the housing to extend in front of a human head held within the headband. The face shield is configured to extend in front of a face of a human head held within the headband. The housing pivotally attaches the face shield to the headband support assembly between a packaged configuration and an operational configuration, in which the headband assembly is positioned to be placed over a human head. The apparatus occupies considerably less space within the package as held in the packaged configuration. The hood includes a sheet of flexible material having a front opening, around which the face shield is attached, so that the face shield extends within the front opening.

In accordance with yet another aspect of the invention, a method for using a helmet/hood assembly is provided, including steps of receiving the helmet/hood in a packaged configuration, within a package;

removing the helmet/hood from the package pivoting a face shield within the helmet/hood relative to a headband support assembly within the helmet/hood to change the helmet/hood from the packaged configuration, in which the helmet/hood requires less space within the package, to an operational configuration, in which a headband in the headband support assembly can be placed over a human head;

attaching the face shield to the headband support assembly;

placing the helmet/hood on a person;

wearing the helmet/hood during a surgical procedure;

removing the helmet/hood from the person; and disposing the helmet/hood.

BRIEF DESCRIPTION OF THE FIGURES

These and other aspects of the invention will be made apparent by reading the following specification in conjunction with the accompanying drawings, in which:

FIG. 1 is a schematic cross-sectional view of a conventional helmet/hood assembly.

FIG. 2 is a schematic view of a process for preparing the conventional helmet/hood of FIG. 1 for use;

DETAILED DESCRIPTION OF THE INVENTION

Figure 4:
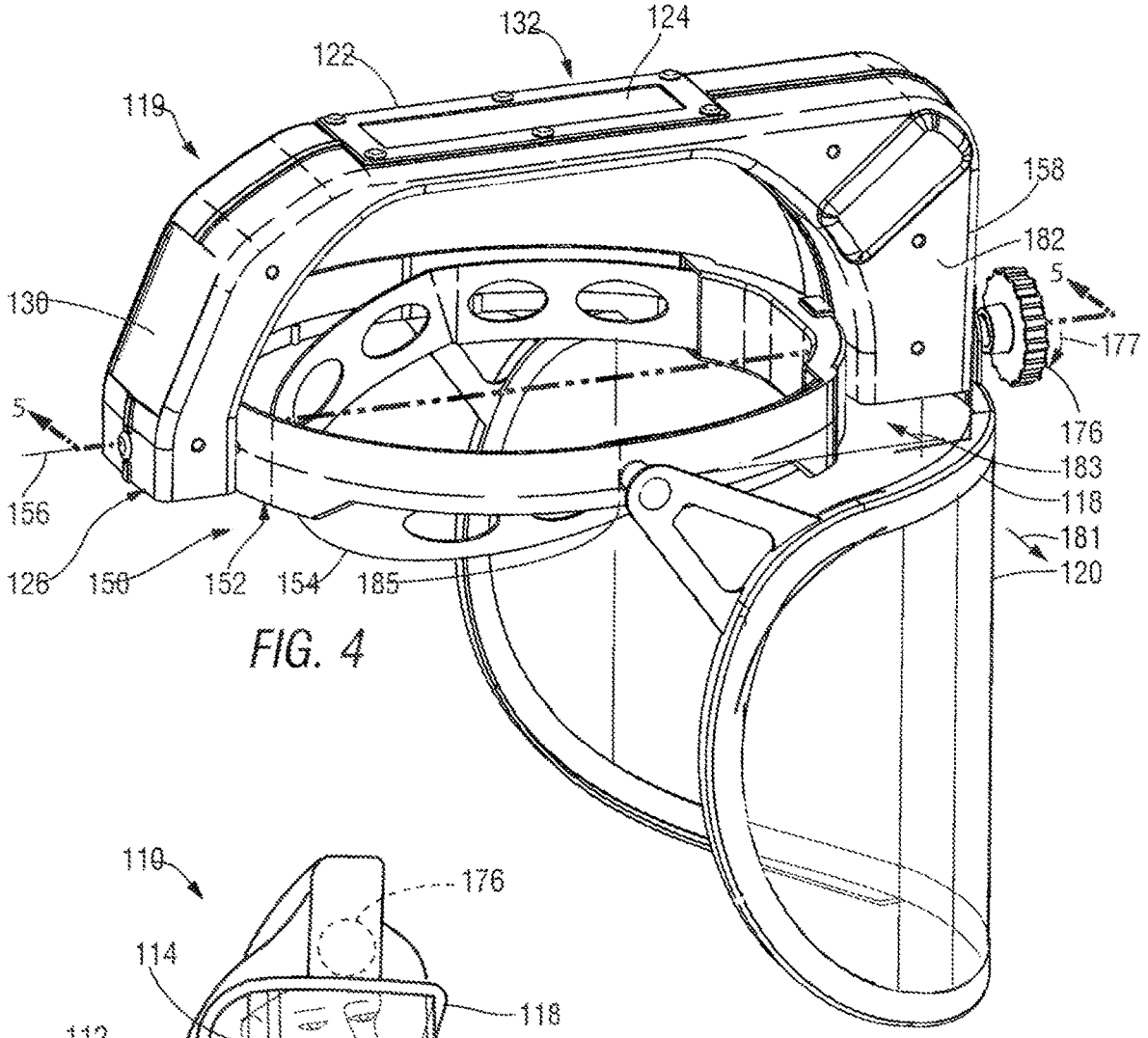
FIG. 4 is a side perspective view of the helmet/hood assembly of FIG. 3, shown with the hood removed to reveal internal structures.
Figure 3:
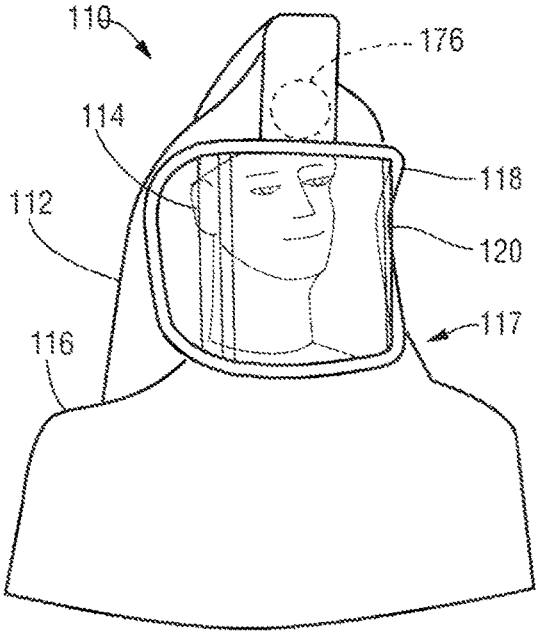
FIG. 3 is a front perspective view of a helmet/hood assembly built in accordance with a first embodiment of the present invention.
Figure 5:
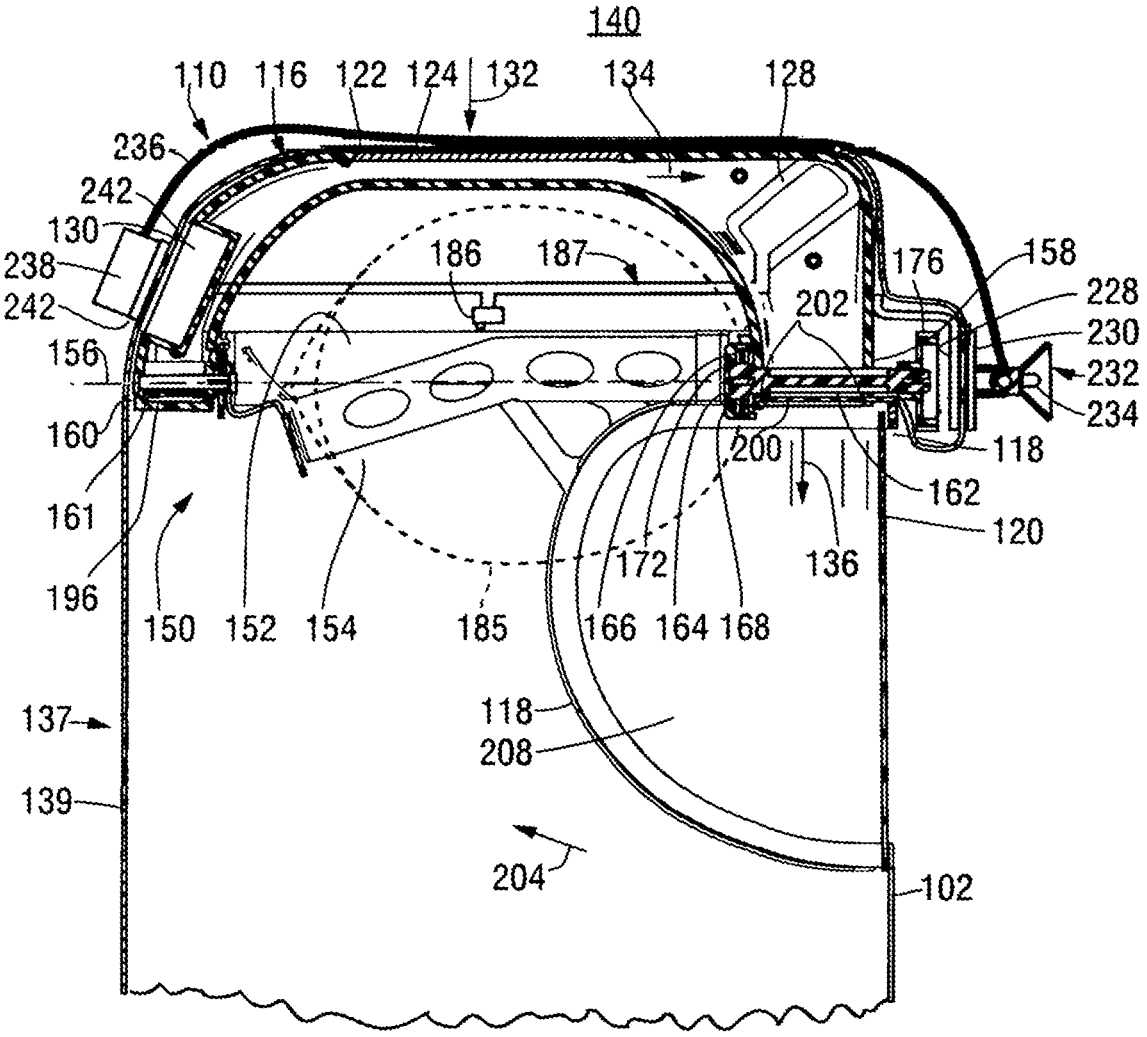
FIG. 5 is a fragmentary longitudinal cross-sectional elevation of the helmet/hood assembly of FIG. 3. taken as indicated by section lines 5-5 in FIG. 4.

A helmet/hood assembly 110, built in accordance with a first embodiment of the invention to include a hood 112 arranged for covering the head 114 and shoulders 116 of the wearer 118, will first be discussed with reference being made to FIGS. 3-5, which each show the apparatus an operational configuration to be worn in a surgical environment. FIG. 3 is a perspective front view of the helmet/hood assembly 110 as worn by the wearer 118. FIG. 4 is a perspective side view of a helmet subassembly 119 within the helmet/hood assembly 110, taken from a right side thereof and from above, being shown with the hood 112 removed to reveal details of the helmet subassembly 119. FIG. 5 is a cross-sectional elevation of the helmet/hood assembly 110, taken as indicated by section line 5=5 in FIG. 4.

The hood 112 is fastened to a front frame 118 holding a curved transparent face shield 120 and to an upper frame 122 holding an air filter 124. As shown particularly in FIG. 5, the helmet subassembly 119 additionally includes a housing 126 holding an electric fan 128 powered by a battery 130, with the housing 126 serving as an air duct. The fan 128, which is, for example, a centrifugal flow device, pulls air inward, in the direction of arrow 132, through the filter 124, moves the air forward, in the direction of arrow 134, within the housing 126 to be exhausted downward, in the direction of arrow 136, within the hood 112 and the face shield 120. As shown in FIG. 5, the hood 112 additionally includes a posterior air outlet 137, covered by an air filter 139.

It is noted that the helmet/hood assembly 110 is configured to produce a constant flow of fresh air through the helmet/hood apparatus 110, with air being drawn through the filter 124 from a space 140 above the helmet/hood apparatus 110. The posterior air outlet 137, which is provided so that the flow of fresh air can easily be maintained. In particular, air is taken from the space 140 above the helmet/hood assembly 10 because this space, being away from the space in which blood splatter is likely to occur, is naturally free of airborne contamination, and because hospitals provide patterns of airflow to keep such spaces free from contamination. This configuration has a significant advantage over the prior art devices described above in reference to FIG. 1, which lack a provision for pulling air inward through the top of the hood. The constant flow of fresh air prevents an accumulation of carbon dioxide within the helmet hood assembly 110.

It is further noted that supplying the battery as a part of the disposable helmet/hood assembly 110 provides the present invention with significant advantages over the use of a rechargeable battery in prior art devices, as described above in reference to FIGS. 1 and 2. The difficulties of handling batteries through a recharging process are eliminated, and the helmet/hood assembly 110 becomes a becomes a selfcontained electrical device with its own power source, allowing its use without additional provisions in areas where electrical power is not available, such as remote locations and disaster areas.

The helmet subassembly 119 further includes a headband support assembly 150 for supporting the helmet/hood assembly 110 on the head 114 of the wearer 118. The headband support assembly 150 in turn includes a support ring 152 extending loosely around the head 114 and a headband 154 that can be adjusted to extend more tightly or more loosely around the head 114. The headband support assembly 150 is mounted to pivot within the housing 126 about a pivot axis 156 extending between a front end portion 158 of the housing 126 and the rear end portion 160 thereof, with the headband support assembly being disposed below a central portion 161 of the housing 126. Both the front end portion 158 and the rear end portion extend downward from the central portion 161. For example, the pivot axis 156 is formed by a rear pivot pin 161, snapped in place within the rear end 160 of the housing and a front adjustment shaft 162, which holds an adjustment gear 164 in meshing engagement with an upper adjustment rack 166 and a lower adjustment rack 168. The adjustment racks 166, 168 are formed along opposite ends 170 of the headband 154, which extend in opposite directions within a slotted enclosure 172 formed to extend along the support ring 152. For example, the adjustment shaft 162 includes a central portion 173 having a cruciform cross-sectional shape.

For example, the headband support assembly 150 is configured so that, when the adjustment knob 176 is turned in the direction of arrow 177, both the upper adjustment rack 166 and the lower adjustment rack 168 are moved outward within the slotted enclosure 172, loosening the headband 154. On the other hand, when the attachment knob 176 is turned opposite the direction of arrow 177, both the adjustment racks 166, 168 are moved inward within the slotted enclosure 172, tightening the headband 154. The adjustment gear 164 and an external adjustment knob 176 are snapped onto the adjustment shaft 162 so that the adjustment knob 176 can be used to adjust the tightness of the headband 154. The headband support assembly 150 is pivotally attached to the housing 126, with a front opening 178 and a rear opening 180, both extending through the support ring 152, being pivotally held on the front adjustment shaft 162 and the rear pivot pin 160. Even though the adjustment knob 176 is disposed under the hood 112, it can be easily felt and used through the hood 112 without moving a hand out of the sterile field area, providing a significant advantage over the prior art devices that have adjustment knobs in the back.

FIGS. 3-5 show the helmet-hood assembly 110 with the support ring subassembly 150 in an operational configuration, in which it would be worn and used. Referring particularly to FIG. 4, with the support ring 150 in the operational configuration, the headband 154 extends outward, in a horizontal direction indicated by arrow 181 beyond a lateral side 182 of the housing 126 through a substantial distance indicated as 183. The opposite side 184 of the headband 154 additionally extends horizontally outward from a lateral side (not shown) opposite the lateral side 182 through a similar distance 183.

Referring to FIG. 5, the headband support assembly 150 is pivoted about the pivot axis 156 through a ninety-degree angle between the operational configuration in which it is shown and a storage configuration, in which the headband 154 extends vertically, as shown by dashed lines 185 below the central portion 173 without extending outwardly beyond the lateral side 182 of the housing 126, and additionally without extending beyond the opposite lateral side (not shown) thereof. In this way, the width of the helmet/hood assembly 110 is substantially reduced for shipment and storage.

For example, moving the headband support assembly 150 into the operational configuration to prepare the helmet/hood assembly for use may be used to turn the fan 128 on, with a switch 186 actuated by moving the headband support assembly into the service configuration being provided within a circuit 187 connecting the fan 128 with the battery 130. In the example of FIG. 5, the switch 186 is closed by upward movement of an edge 187*a* of the support ring 152 and held closed as long as the headband support assembly 150 is held in the operational configuration.

Figure 6:
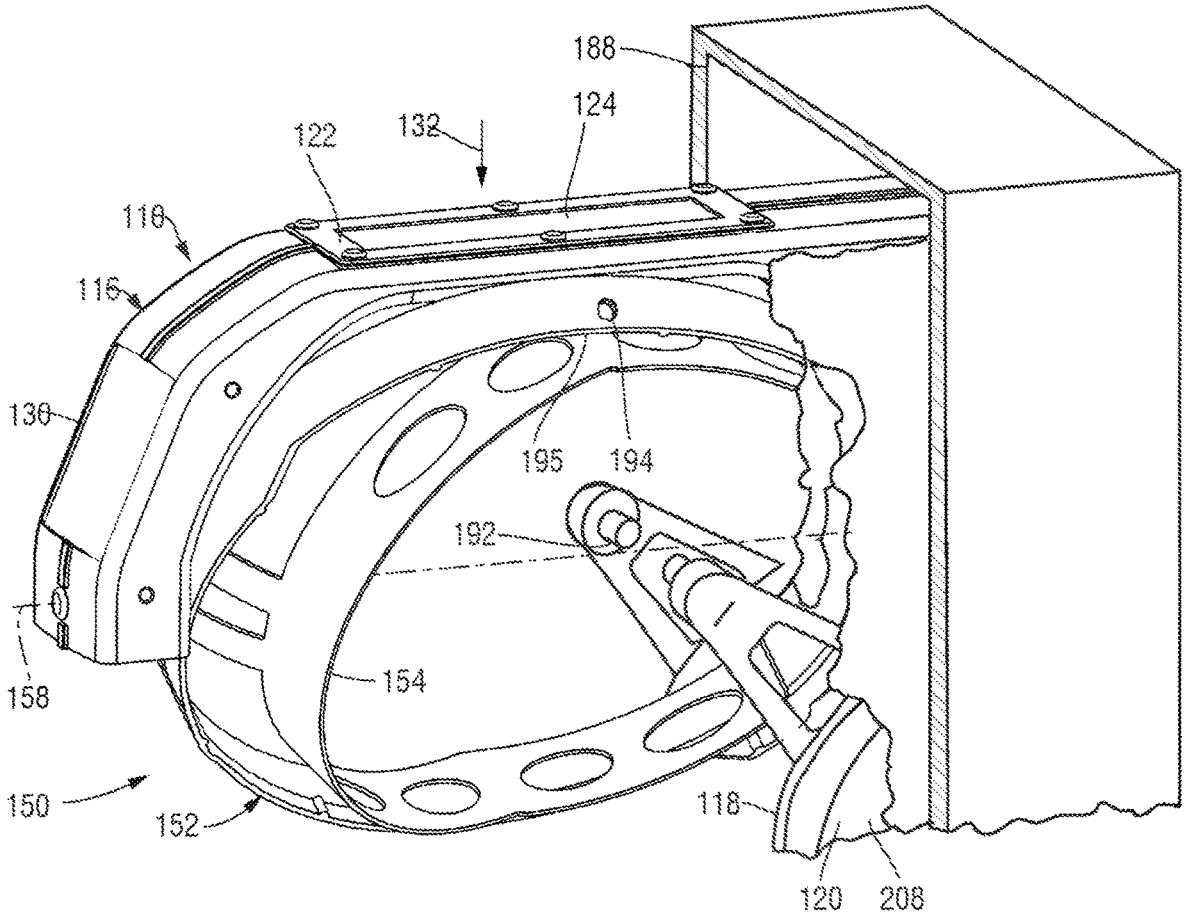
FIG. 6 is a fragmentary perspective view of the helmet/hood assembly of FIG. 3, shown as packaged for storage and shipment.
Figure 11:
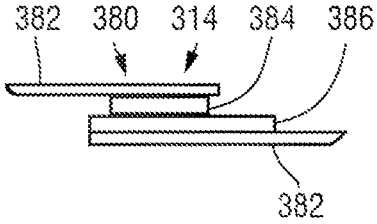
FIG. 11 is a fragmentary plan view of a headband within the helmet/hood assembly of FIG. 7, showing overlapping ends of an elongated member forming the headband.

FIG. 6 is a fragmentary perspective view of the helmet/hood assembly 110 within a 12.7 cm by 28 cm by 35.5 cm (5 in by 11 in by 14 in) package 188 for storage or shipment. The headband support assembly 152 us shown as being disposed at an oblique angle, between the operational configuration and the storage configuration, allowing the depiction of details within the headband support assembly 152. Referring to FIGS. 4 and 6, it is noted that the helmet subassembly 119 additionally includes several stabilizing members releasably holding the headband support assembly 150 in the operational configuration, as shown in FIGS. 11-3, by preventing rotation of the headband support assembly 150 about the pivot axis 156. For example, the stabilizing members include a pair of attachment structures 192 that are snapped into place on to extend inward within openings 194 at each side 195 of the support ring 152, and a detent pin 196 extending outward from a rear portion 198 of the support ring 152. When the attachment structures 192 and the detent pin 196 are not connected to their mating structures, the support assembly can be rotated in either direction between the operational configuration of FIGS. 4 and 5, and the storage configuration.

As shown in FIG. 5, the front frame 118 and the face shield 120 are attached to the housing 126 by a flexible tab 200 extending through slots 202 within the housing 126. When the attachment structures 192 and the detent pin 198 are not connected to their mating structures, the front frame 228 and the face shield 120 can be pivoted inward and upward, in the direction of arrow 204 by deflecting the flexible tab 200, reducing the space required for the front frame 118 and the face shield 120 within the package 188 Furthermore, when the attachment structures 192 are not connected with their mating structures with the support assembly in the storage of the configuration of FIG. 6, the opposite sides 208 of the face shield 120 are squeezed into the shape shown in FIG. 6 when the helmet/hood assembly 110 is placed in the package 188, additionally reducing the space required in the package 186.

Referring again to FIG. 5, the helmet/hood assembly 110 may be optionally provided with an outwardly facing magnetically attractable plate 228 in a front portion of the helmet subassembly 119, such as in front of the adjustment knob 176. The first magnetically attractable plate 228 is attracted to a second magnetically attractable plate 230 within an accessory light 232, which is therefore held in place on the helmet subassembly 119 by a magnetic field extending between the magnetically attractable plates 228, 230. For example, the first magnetically attractable plate 228 is composed of a ferromagnetic material, while the second magnetically attractable plate 230 is a permanent magnet. The accessory light 232 includes an electrically operated light 234, connected by an electrical cable 236 to a battery unit 238. Preferably, the helmet subassembly 119 additionally includes a third magnetically attractable plate 240, which attracts a fourth magnetically attractable plate 242 to hold the battery unit 238 in place on the helmet/hood assembly 110. For example, the third magnetically attractable plate 240 is composed of a ferromagnetic material, while the fourth magnetically attractable plate 242 is a permanent magnet.

Figure 7:
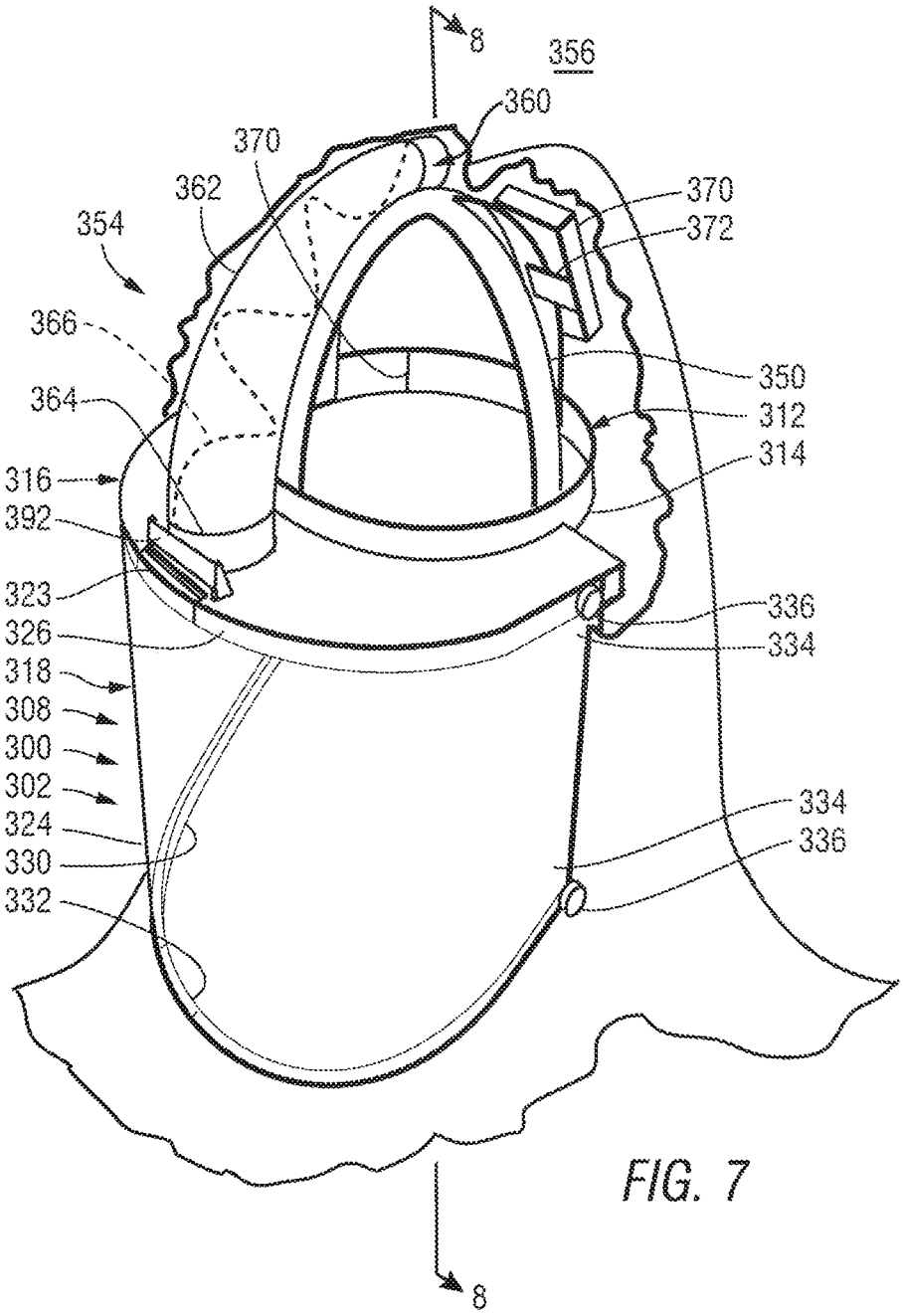
FIG. 7 is a front perspective view of a helmet/hood assembly built in accordance with a second embodiment of the present invention.
Figure 8:
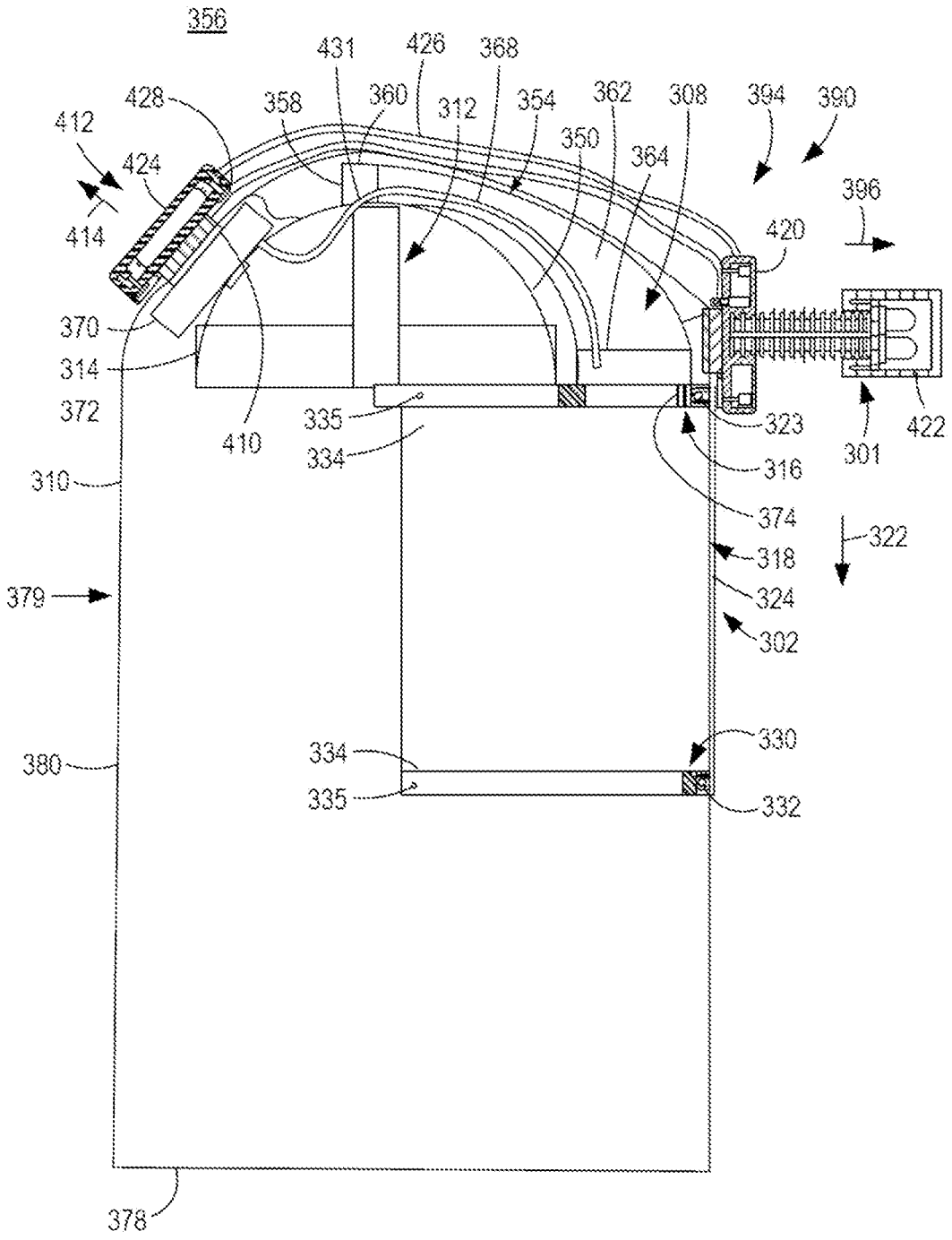
FIG. 8 is a longitudinal cross-sectional elevation of the helmet/hood assembly of FIG. 7, taken as indicated by section lines 8-8 therein and shown as an operational configuration.
Figure 9:
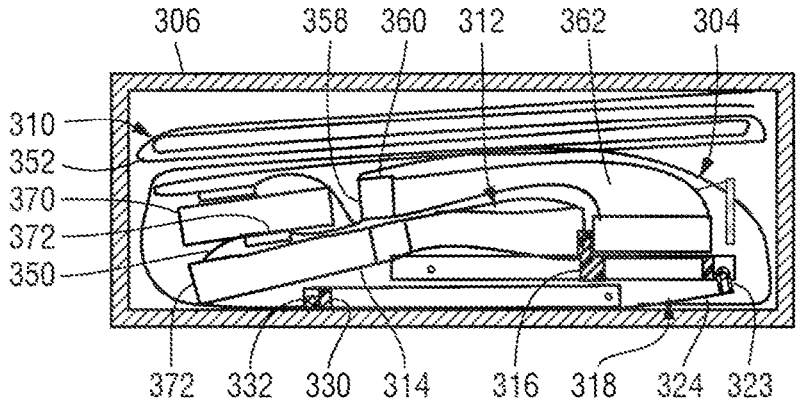
FIG. 9 is a longitudinal cross-sectional elevation of the helmet/hood assembly of FIG. 7, shown in a packaged configuration.
Figure 10:
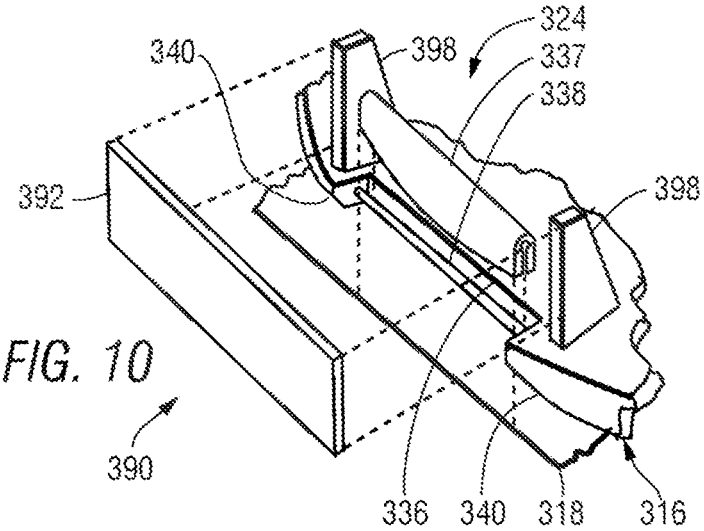
FIG. 10 is a fragmentary perspective view of the helmet/hood assembly of FIG. 7, showing a hinge assembly therein, with elements in an exploded relationship.

A second embodiment of the invention will now be discussed, with reference being made to FIGS. 7-9, which show a helmet/hood assembly 300. FIG. 7 is a front perspective view of the helmet/hood assembly 300, while FIG. 8 is a longitudinal cross-sectional elevation thereof, taken as indicated by section lines 8-8 in FIG. 7, together with an accessory light 301. While FIGS. 7 and 8 show the helmet/hood 300 in an operational configuration 302, in which the helmet/hood assembly 300 can be worn by a human being, FIG. 9 is a longitudinal cross-sectional elevation of the helmet/hood assembly 300, additional taken as indicated by section lines 9-9 in FIG. 8, but showing the helmet/hood assembly 300 in a packaged configuration 304, being held within a box 306. The helmet/hood assembly 300 includes a helmet 308 and a hood 310. The helmet 308 includes a headband support assembly 312, including a headband 314, with both the headband support assembly 312 and the headband 314 being configured to extend around a human head (not shown). The helmet 308 additionally includes a housing 316 and a face shield 318 attached to a front surface 320 of the housing 316 to extend downward, in the direction of arrow 322, with the helmet/hood assembly 300 in the operational configuration 302 Since the face shield 318 extends substantially below the housing 316 and the headband support assembly 312 with the helmet/hood assembly 300 in the operational configuration 302 of FIGS. 7 and 8, the face shield 318 is pivotally attached to the housing 316 by a hinge 323, allowing the face shield 318 to be pivoted to extend horizontally, parallel to the housing 316, in the packaged configuration 304, as shown in FIG. 10. In the packaged configuration 104, the face shield extends generally in a flat, horizontal condition.

The face shield 318 includes a flexible transparent sheet 324, which is held in place and in a convex shape in the operational configuration 302 of FIGS. 7 and 8 by attachment to a curved front surface 320 of the housing 316, and, preferably, additionally by attachment to a curved front surface 328 of a lower frame member 330, which is pivotally attached to the face shield 318 by a hinge 332. In the operational configuration 302, the four corners 334 of the face shield 318 are preferably attached to the housing 316 and to the lower frame member 330 by fasteners 335, holding the face shield 318 in a convex shape and additionally holding the helmet/hood in the place. In the packaged configuration 304 the face shield is held in a generally flat and horizontal condition.

FIG. 10 is a perspective elevation of the hinge 324 pivotally attaching the face shield 318 to the housing 316, with various elements of the hinge 324 being shown in an exploded relationship with one another. The housing 316 includes a notch 336 through which a cylinder 337 extends. A clip 338 is pushed into place over the cylinder 337 and attached, for example by an adhesive, to the face shield 318. The clip 338 is configured so that the face shield 318 is spaced away from the housing 316 in the packaged configuration 304, providing space for the lower frame member 330 between the housing 316 and the face shield 318. Recessed areas 340 are provided in the curved front surface 326 of the housing 316 to allow the face shield 318 to move easily into the position needed for the operational configuration 302. The hinge 332 pivotally attaching the lower frame member 330 to the face shield 318 is similar to the hinge 234, except that the hinge 232 is configured to hold the lower frame member 330 close to the face shield 318 with the helmet/hood apparatus in the packaged configuration 302.

Continuing to refer to FIGS. 7-10, the headband support assembly 312, which includes the headband 314 and a headband support member 350, is preferably collapsible under the application of a downward force from above. With the helmet/hood assembly 300 in the packaged configuration 304 within the closed box 306, such a force is applied by a folded portion 352 of the hood 310.

The helmet/hood assembly 300 additionally includes an air supply system 354 moving air from a region 356 above and behind the helmet/hood assembly 300 through an inlet hole 358 in the hood 310, through an air filter 360, and an air duct 362, into an electrically driven fan 364. The air duct 362 is preferably additionally collapsible under the application of a downward force from above, allowing the force applied by the folded portion 352 of the hood 310 to compress the air duct 362 in the packaged configuration 304. In the operational configuration 302, a tapered coil spring 366 within the air duct 362 holds the air duct 362 upward and open, so that air can move easily through the air duct 362. The electrically driven fan 364, which receives electrical power through an electrical cable 368 from a pack 370 attached to the headband support assembly 312 with a clip 372. The electrically driven fan 364 blows air through a housing hole 374 within the housing 316 into a space 376 rearwardly adjacent the face shield 318. When a human wearer is wearing the helmet/hood assembly 300, this space 376 is disposed between the face shield 318 and the face of the wearer. Preferably, air exits the helmet/hood assembly 300 below the lower edge 378 of the hood 310 and through one or more outlet holes 379 in a rear portion 380 of the hood 310.

FIG. 11 is a fragmentary plan view of an overlapping region 380 within the headband 314, which is formed as an elongated strap having ends 382 overlapping through a variable distance to provide for adjustment of a circumference of the headband 314. For example, hook and loop fastening elements sold under the trademark VELCRO are used, with one of the ends 382 having a hook-type fastening pad 384 and with the other end 382 having a loop type fastening pad 386.

Continuing to refer to FIGS. 7-10', the helmet/hood assembly 300 preferably additionally includes an accessory attachment structure 390 for removably attaching an accessory, such as the helmet light 301 shown in FIG. 8. For example, the accessory attachment structure 390 includes a first magnetically attractable plate 392, disposed at a front portion 394 of the helmet 308 to face outwardly and forwardly, in the direction of arrow 396, being attached to the housing 316. As shown particularly in FIG. 10, the first magnetically attractable plate 392 may be adhesively attached to a pair of tabs 398 extending upward as parts of the housing 318. The accessory attachment structure 390 may additionally include a second magnetically attractable plate 410, disposed at a rear portion 412 of the housing 308, to face outwardly and rearwardly, in the direction of arrow 414, being attached to the battery holder 370, for example, by an adhesive.

The helmet light 301 includes a front housing 420 holding an illumination source 422 powered by electricity and a rear housing 424 with a central frame 426 extending between the front and rear housings 420, 424 and attaching the front and rear housings 420, 424 to one another. Each of the housings 420, 424 within the helmet light 301 includes an attachment structure 428 that is magnetically attractable to one of the magnetically attractable plates 392, 410 of the helmet/hood assembly 300. Preferably, the magnetically attractable plates 392, 410 composed of a ferromagnetic material, such as steel, while the attachment structures 428 are permanent magnets. Power for the illumination source 422 is provided from batteries 430, held within the rear housing 424, through an electrical cable 431 extending between the rear housing 424 and the front housing 420. An electrical switch 432 may additionally be provided within the front housing 420, so that the illumination source 422 is turned on when the helmet light 301 is placed on the helmet/hood assembly 300 and off when the helmet light 301 is removed from the helmet/hood assembly 300.

Figure 12:
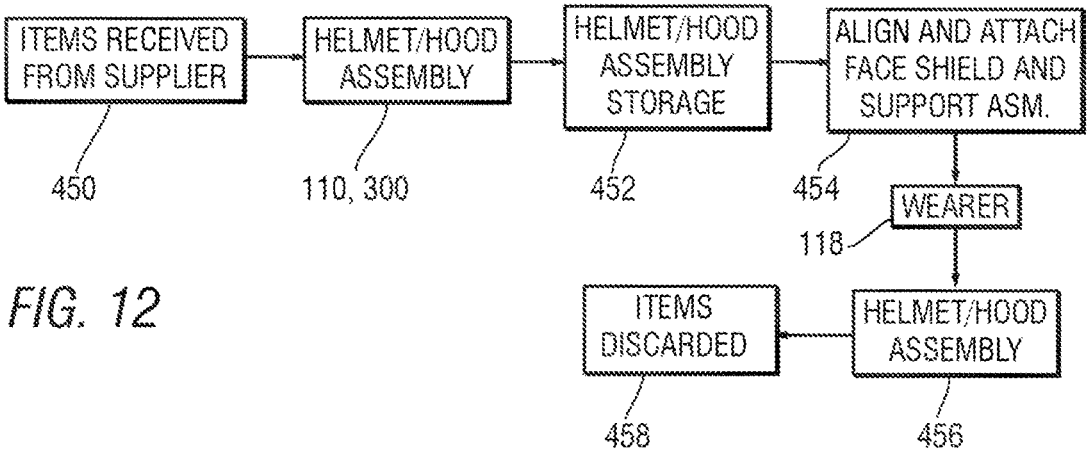
FIG. 12 is a schematic view of a process for preparing and using the helmet/hood assembly of FIG. 3 or the helmet/hood assembly of FIG. 7.

FIG. 12 is a schematic view of the flow of parts within a hospital to provide helmet/hood assemblies 110, 300 as needed for operating room personnel. In this process, the helmet/hood assembly 119, configured in accordance with the first embodiment, or helmet/hood assembly 300, configured in accordance with the second embodiment, packaged as described above in reference to FIGS. 6 and 9, is received from a supplier at 350 and stored in helmet/hood assembly storage 352. When it is time to prepare the helmet/hood assembly 110, 300 for placement on a wearer 118, in step 354, the helmet/hood assembly 110, 300 is removed from the package 188 or the box 306 and the headband support assembly 150 and the face shield 120 are aligned into the operational configuration of FIGS. 3-5 or the operational configuration 302 of FIGS. 7 and 8.

To prepare the helmet/hood assembly 110, as the headband support assembly 150 is thus rotated into the operational configuration, the detent pin 196 moves into place to lock the headband support assembly 150 in place. As the face mask 120 is additionally brought into configuration, the attachment structures 192 are brought into alignment with the openings 194 in each side 195 of the support ring 152 and are snapped into place within these openings 194 so that the headband support assembly 150 and the face shield 120 are subsequently retained in the operational configuration.

Alternately, to prepare the helmet/hood assembly 300, face shield 318 is pivoted downward from the hinge 223, and the lower frame member 300 is pivoted downward from the hinge 332. Then, the corners 334 of the face shield are attached to the housing 316 and the lower frame member 330 by fasteners 335.

The helmet/hood assembly 110, 300 is then placed on the wearer 118. When the surgical procedure has been completed, the used helmet/hood assembly 356 is removed from the wearer 118 and discarded at 358. The method of providing the helmet/hood assembly 110, 300 as a single, disposable packaged unit provides the present invention with a number of significant advantages over the prior art devices described above in reference to FIGS. 1 and 2. The helmet/hood assembly 110 is easily provided and stored in sterilized packaging. There is no need to replace individual items, such as sweat bands and a face shield so that the apparatus can be reused. Concerns that infectious agents may build up within a helmet as it is used by multiple wearers and that such infections agents may be spread from one area to another as the helmet is moved around are eliminated. The process of preparing the apparatus within the hospital for use by and individual wearer is greatly simplified.

While the invention has been described in terms of preferred embodiments with some degree of particularity, it is understood that this description has been given only by way of example, and that many changes can be made without departing from the spirit and scope of the invention, as defined in the appended claims.

What is claimed is:

1. A helmet comprising:

a headband support assembly including a headband;

a face shield including a flexible transparent film sheet, the face shield having upper and lower edge portions;

a housing attached to the headband support assembly with the headband support assembly extending upward from the housing, wherein the housing includes a curved front surface extending outward from the headband support assembly;

an upper hinge attaching the upper edge portion of the face shield to the curved front surface of the housing, wherein the curved front surface extends outward and rearward to rear ends of the housing, wherein the upper hinge is configured to pivot the face shield between Q a packaged configuration, extending horizontally adjacent a lower surface of the housing, and (ii) an operational configuration, extending vertically downward from the housing, and wherein the helmet is configured for the headband and the headband support assembly to extend around a human head with the face shield extending downward;

a first pair of fasteners, configured for holding upper corners of the face shield to the rear ends of the curved front surface of the housing to hold the upper edge portion of the face shield in the operational configuration in a convex shape;

a lower frame member having a curved front surface;

a lower hinge attaching the lower edge portion of the face shield to the lower frame member, wherein the lower hinge is configured to move between a position allowing the lower frame member to extend horizontally with the face shield additionally extending horizontally in the packaged configuration and a position allowing the lower frame member to extend horizontally with the face shield extending vertically in the operational configuration, and a second pair of fasteners, configured for holding lower corners of the face shield to rear ends of the curved front surface of the lower frame member to hold the lower edge portion of the face shield in the operational configuration in a convex shape.

2. The helmet of claim 1, further comprising:

a hood, including a sheet of flexible material having a front opening and an inlet hole, disposed centrally above the headband, wherein the hood is fastened to the face shield with the face shield extending within the front opening;

a battery;

an inlet filter disposed adjacent the inlet hole;

an air supply duct extending from the inlet hole adjacent the inlet filter to a hole within the housing through which air is moved downward, inwardly adjacent the face shield, with the helmet in the operational configuration, wherein the air supply duct comprises a flexible tube extending above the headband support assembly, and wherein the air supply duct and the headband support structure are substantially compressible by a downward force applied from above and a fan, driven by the battery to move air through the air supply duct.

3. The helmet of claim 1, wherein the air supply duct further comprises a coiled spring within the flexible tube.

4. A packaged product comprising a helmet/hood and a box wherein the helmet/hood comprises:

a headband support assembly including a headband; a face shield including a flexible transparent film sheet, the face shield having upper and lower edge portions, a housing attached to the headband support assembly with the headband support assembly extending upward from the housing, an upper hinge attaching the face shield to a front portion of the housing, a hood, including a sheet of flexible material having a front opening and an inlet hole, disposed centrally above the headband, with the hood being fastened to the face shield with the face shield extending within the front opening; a battery; an inlet filter disposed adjacent the inlet hole; and an air supply duct extending from the inlet hole adjacent the inlet filter to a hole within the housing, wherein the air supply duct comprises a flexible tube extending above the headband support assembly and a fan, arranged to be driven by the battery to move air through the air supply duct, the helmet/hood is held within the box in a packaged configuration, with the face shield extending horizontally, between a lower surface of the housing and a lower inner surface of the box, and with the hood folded to extend horizontally, between an upper surface of the housing and an upper inner surface of the box, and with elements disposed between the housing and an upper inner surface of the box, including the headband support assembly, the hood, and the air supply duct being compressed by a downward force from the upper inner surface of the box, the helmet/hood is adaptable, when removed from the box, into an operational configuration, with the housing and the headband support assembly being adapted for placement over a human head by moving a central portion of the headband support assembly upward, with the face shield being pivoted at the upper hinge to extend downward from the housing, providing a space for air from the air supply duct to move downward in front of a face of a the human head held within the headband support assembly and with the hood being arranged to extend downward around the housing.

5. The packaged product of claim 4, wherein:

the housing includes a curved front surface extending outward from the headband support assembly;

the helmet/hood further comprises a first pair of fasteners, configured for holding upper corners of the face shield to rear ends of the curved front surface of the housing; a lower frame member having a curved front surface; a lower hinge attaching the lower edge portion of the face shield to the lower frame member, wherein the lower hinge is configured to move between a position allowing the lower frame member to extend horizontally with the face shield additionally extending horizontally in the packaged configuration and a position allowing the lower frame member to extend horizontally with the face shield extending vertically in the operational configuration, and a second pair of fasteners, configured for holding lower corners of the face shield to rear ends of the curved front surface of the lower frame, the helmet/hood is held within the box in the packaged configuration with the lower frame member extending horizontally between the lower inner surface of the box and the lower surface of the housing, and the helmet/hood is additionally adaptable, when removed from the box, into an operational configuration with the first pair of fasteners attaching upper corners of the face shield to the rear ends of the curved front surface of the housing and with the second pair of fasteners attaching lower corners of the face shield to the rear ends of the curved front surface of the lower frame member, so that the face shield is held in a convex shape.

6. The packaged product of claim 4, wherein the air supply duct further comprises a coiled spring within the flexible tube, adapted to hold the air supply duct upward and open when the helmet/hood is in the operational configuration.

7. A helmet/hood assembly comprising: a helmet comprising: a headband support assembly including a headband and a support ring, the headband support assembly being adapted and sized for placement over a human head; a face shield comprising a flexible transparent film sheet, the face shield having a top edge and a lower edge portion; a housing attached to the headband support assembly, the housing comprising a curved front surface extending outward from the headband support assembly; and an upper hinge attaching the face shield to the curved front surface of the housing, the upper hinge being centrally located along the top edge of the face shield, the upper hinge enabling the face shield to move from (i) a storage configuration in which the face shield extends horizontally along a lower surface of the housing to (ii) an operational configuration in which the face shield extends vertically downward from the curved front surface of the housing and in front of a face of the human head; and a hood comprising: a sheet of flexible material having (i) a front opening and (ii) an inlet hole disposed above the headband, the hood being attachable to the housing such that the face shield is positioned within the front opening.

8. The helmet/hood assembly of claim 7, wherein the helmet comprises an air supply duct extending from the inlet hole to an air outlet of the housing proximate the upper hinge, and the helmet further comprises: a fan positioned within the air supply duct; and a battery for supplying electrical power to the fan so as to move air through the air supply duct.

9. The helmet/hood assembly of claim 7, wherein the helmet further comprises: a first pair of fasteners configured for holding upper corners of the face shield to rear ends of the curved front surface of the housing when the face shield is in the operational configuration.

10. The helmet/hood assembly of claim 7, wherein the helmet further comprises: a lower frame member having a curved front surface; a lower hinge attaching the lower edge portion of the face shield to the lower frame member, wherein the lower hinge is configured to move between a position allowing the lower frame member to extend horizontally with the face shield in the packaged configuration and a position allowing the lower frame member to extend horizontally with the face shield extending vertically in the operational configuration.

11. The helmet/hood assembly of claim 10, wherein the helmet further comprises: a second pair of fasteners configured for holding lower corners of the face shield to rear ends of the curved front surface of the lower frame.

12. The helmet/hood assembly of claim 8, wherein the hood further comprises: a hood air outlet in a rear portion of the hood.

13. A packaged product comprising the helmet/hood assembly of claim 7 within a box.

14. A packaged product comprising the helmet/hood assembly of claim 8 within a box.

* * * * *